US009238517B2

(12) United States Patent
Stopp

(10) Patent No.: US 9,238,517 B2
(45) Date of Patent: Jan. 19, 2016

(54) METHOD OF PACKAGING A FRAGILE ITEM

(71) Applicant: Pratt Industries, Inc., Conyers, GA (US)

(72) Inventor: Michael Anthony Stopp, Acworth, GA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 0 days.

(21) Appl. No.: 14/036,770

(22) Filed: Sep. 25, 2013

(65) Prior Publication Data

US 2014/0083053 A1 Mar. 27, 2014

Related U.S. Application Data

(60) Provisional application No. 61/705,167, filed on Sep. 25, 2012.

(51) Int. Cl.

| | |
|---|---|
| ***B65B 11/00*** | (2006.01) |
| ***B65B 23/20*** | (2006.01) |
| ***B65B 53/00*** | (2006.01) |
| ***B65D 85/48*** | (2006.01) |

(Continued)

(52) U.S. Cl.

CPC ..... *B65B 53/00* (2013.01); *B65B 11/004* (2013.01); *B65B 23/20* (2013.01); *B65D 5/5035* (2013.01); *B65D 81/05* (2013.01); *B65D 85/48* (2013.01); *B65B 2220/16* (2013.01); *B65D 2585/6882* (2013.01)

(58) Field of Classification Search

CPC ..... B65D 85/48; B65D 2585/6882; B65D 5/5028; B65D 5/5035; B65D 73/0014; B65D 11/004; B65D 11/58; B65D 23/20; B65D 2220/16

USPC ..... 53/441, 442, 449, 456, 472, 474; 206/583, 448, 451, 497, 521, 591, 592, 206/593, 594

See application file for complete search history.

(56) References Cited

U.S. PATENT DOCUMENTS

| | | | |
|---|---|---|---|
| 1,676,238 A | 7/1928 | Batty | |
| 2,005,967 A | 6/1935 | Kenneth | |

(Continued)

FOREIGN PATENT DOCUMENTS

| | | | | |
|---|---|---|---|---|
| DE | 2827994 A1 * | 1/1980 | ..... | B65D 5/5035 |
| EP | 133085 A1 * | 2/1985 | ..... | B65D 85/48 |

(Continued)

OTHER PUBLICATIONS

Stopp, Michael Anthony; U.S. Continuation Application entitled: Fragile Item Packaging, having U.S. Appl. No. 14/050,712, filed Oct. 10, 2013, 17 pgs.

(Continued)

*Primary Examiner* — Stephen F Gerrity
(74) *Attorney, Agent, or Firm* — Taylor English Duma LLP

(57) ABSTRACT

A blank includes a main body; at least one support connected to the main body; and at least one support brace connected to at least one of the main body and at least one support. A packaging system includes a blank, the blank including a main body, at least one support connected to the main body, and at least one support brace connected to at least one of the main body and at least one support; and shrinkwrapping. A support may be a panel. A box may be included.

19 Claims, 3 Drawing Sheets

(51) Int. Cl.

| | |
|---|---|
| ***B65D 81/05*** | (2006.01) |
| ***B65D 5/50*** | (2006.01) |

(56) References Cited

U.S. PATENT DOCUMENTS

| | | | | | |
|---|---|---|---|---|---|
| 2,643,050 | A * | 6/1953 | Williams | 206/335 |
| 2,740,518 | A | 4/1956 | Kincaid | |
| 2,841,277 | A * | 7/1958 | Paige | 206/448 |
| 2,873,024 | A * | 2/1959 | Koester | 206/448 |
| 3,028,001 | A * | 4/1962 | Gleim | 206/448 |
| 3,166,188 | A * | 1/1965 | Koester | 206/448 |
| 3,389,785 | A | 6/1968 | Lidgard | |
| 3,403,778 | A | 10/1968 | Voytko et al. | |
| 3,884,356 | A * | 5/1975 | Lidgard | 206/448 |
| 3,992,849 | A * | 11/1976 | Lett, III | 53/449 |
| 4,865,200 | A | 9/1989 | Sullivan et al. | |
| 5,127,525 | A * | 7/1992 | Hummer | 206/586 |
| 5,894,932 | A | 4/1999 | Harding et al. | |
| 6,158,589 | A | 12/2000 | Smith et al. | |
| 6,817,472 | B1 * | 11/2004 | Williams | 206/495 |
| 7,290,662 | B2 * | 11/2007 | Lofgren et al. | 206/583 |
| 7,665,280 | B2 * | 2/2010 | Youell, Jr. et al. | 53/472 |
| 7,731,028 | B2 | 6/2010 | Carroll, Jr. | |
| 8,474,618 | B2 * | 7/2013 | McDowell | 206/448 |
| 8,627,958 | B2 * | 1/2014 | McDonald et al. | 206/583 |
| 2003/0213717 | A1 | 11/2003 | Kanai | |
| 2004/0074798 | A1 | 4/2004 | Taylor et al. | |
| 2004/0188309 | A1 * | 9/2004 | Kudou et al. | 53/449 |
| 2005/0183978 | A1 | 8/2005 | Christensen et al. | |
| 2008/0237088 | A1 | 10/2008 | Carroll | |

FOREIGN PATENT DOCUMENTS

| | | | | |
|---|---|---|---|---|
| EP | 556093 | A1 * | 8/1993 | 53/472 |
| EP | 1568619 | A1 * | 8/2005 | B65B 23/20 |
| FR | 2760729 | A1 * | 9/1998 | B65D 85/48 |

OTHER PUBLICATIONS

Stopp, Michael Anthony; Restriction Requirement for U.S. Appl. No. 14/050,712, filed Oct. 10, 2013, mailed Jan. 23, 2014, 6 pgs.

Stopp, Michael; U.S. Provisional Patent Application entitled: Fragile Item Packaging, having U.S. Appl. No. 61/705,167, filed Sep. 25, 2012, 13 pgs.

Stopp, Michael Anthony; Non-Final Office Action for U.S. Appl. No. 14/050,712, filed Oct. 10, 2013, mailed Mar. 21, 2014, 15 pgs.

Stopp, Michael Anthony; Non-Final Office Action for U.S. Appl. No. 14/050,712, filed Oct. 10, 2013, mailed Jul. 22, 2014, 23 pgs.

Stopp, Michael Anthony: Final Office Action for U.S. Appl. No. 14/050,712, filed Oct. 10, 2013, mailed Dec. 9, 2014, 11 pgs.

Stopp, Michael Anthony; Non-Final Office Action for U.S. Appl. No. 14/050,172, filed Oct. 10, 2013, mailed Mar. 24, 2015, 9 pgs.

Stopp, Michael Anthony; Advisory Action for U.S. Appl. No. 14/050,712, filed Oct. 10, 2013, mailed Oct. 28, 2015, 3 pgs.

Stopp, Michael Anthony; Final Office Action for U.S. Appl. No. 14/050,712, filed Oct. 10, 2013, mailed Aug. 24, 2015, 12 pgs.

* cited by examiner

METHOD OF PACKAGING A FRAGILE ITEM

REFERENCE TO RELATED APPLICATIONS

This application claims priority to U.S. Provisional Application No. 61/705,167, filed Sep. 25, 2012, which is hereby specifically incorporated by reference herein in its entireties.

FIELD

This disclosure relates to packaging. More specifically, this disclosure relates to packing large fragile items.

BACKGROUND

Packaging large and/or potentially fragile goods poses a challenge to manufacturers and consumers alike. For example, manufacturers of glass products are faced with the challenge of shipping the glass safely and economically. Similar challenges exist for individuals and manufacturers shipping large framing.

SUMMARY

A blank includes a main body; at least one support connected to the main body; and at least one support brace connected to at least one of the main body and at least one support. A packaging system includes a blank, the blank including a main body, at least one support connected to the main body, and at least one support brace connected to at least one of the main body and at least one support; and shrinkwrapping. A support may be a panel. A box may be included.

DESCRIPTION OF THE FIGURES

The features and components of the following figures are illustrated to emphasize the general principles of the present disclosure and are not necessarily drawn to scale. Corresponding features and components throughout the figures may be designated by matching reference characters for the sake of consistency and clarity.

DETAILED DESCRIPTION

Packaging methods, systems, and apparatus are disclosed herein to address the economical and reliable shipment of large fragile items such as auto glass, windows, and frames. One of skill in the art would understand that the various methods and systems disclosed herein are not a comprehensive listing of all possible embodiments of the disclosure, and various modifications and changes would be understood by one of skill in the art as being included within the scope of the disclosed embodiments.

Shipment of large fragile items such as auto glass can pose great problems to manufacturers and consumers. A long felt need in the industry is finding an economic method of shipping such items that is reliable for repeated use. Prior solutions include bubble wrap, foam, and Styrofoam packaging with varying results as to the reliability of the packaging solution. Generally, the more expensive a solution, the better it protects against drops and jarring of the packed items. For example, one solution places Styrofoam spacers at the corners of such large fragile item. While this method can be reliable in certain applications, the cost of such Styrofoam spacers can discourage continued usage.

The methods, systems, and apparatus disclosed herein allow a user and/or manufacturer to package large and/or fragile items such as auto glass, windows, and framing reliably without excessive cost. The system of the current embodiment utilizes only corrugated cardboard and shrinkwrap to provide a reliable and cost-effective packaging solution for large and potentially-fragile items.

Figure 1:
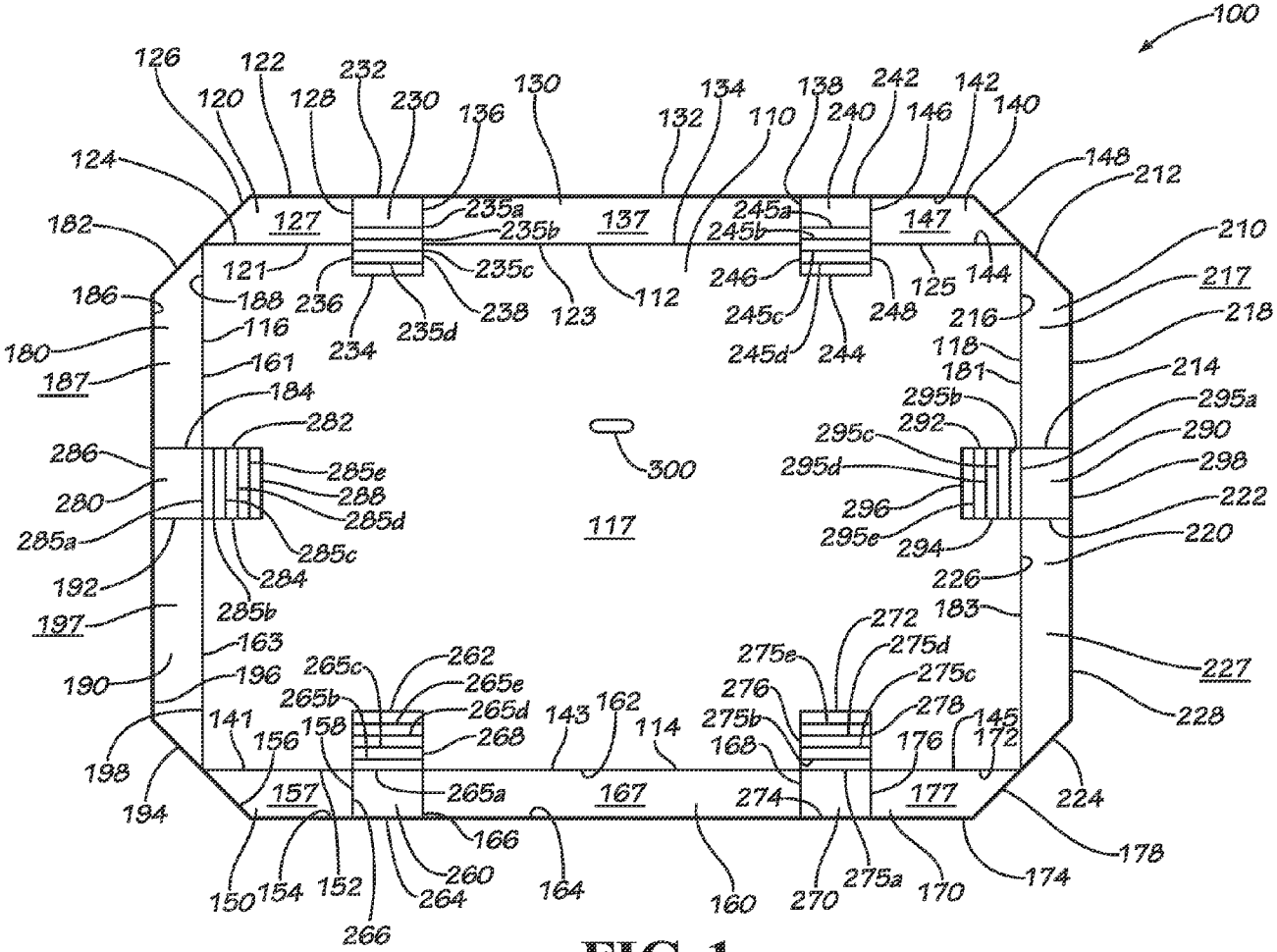
FIG. 1 is a view of a layout for a blank in accord with one embodiment of the current disclosure.

A layout of a blank 100 for use in packaging fragile items such as those described elsewhere herein is seen in FIG. 1. The blank includes a main body 110. The main body 110 includes a top body end 112, a bottom body end 114, a left body end 116, and a right body end 118. The top body end 112 includes a first portion 121, a second portion 123, and a third portion 125. In the current embodiment, the first portion 121 is proximate the left body end 116, the third portion 125 is proximate the right body end 118, and the second portion 123 is central to the top body end 112. Similarly, the bottom body end 114 includes a first portion 141 proximate the left body end 116, a third portion 145 proximate the right body end 118, and a second portion 143 central to the bottom body end 114. The main body 110 includes an inner surface 117 and an outer surface (not shown).

The left body end 116 includes a first portion 161 proximate the top body end 112 and a second portion 163 proximate the bottom body end 114. Similarly, the right body end 118 includes a first portion 181 proximate the top body end 112 and a second portion 183 proximate the bottom body end 114.

Ten supports are connected to the main body 110. In the current embodiment, the ten supports are flaps or panels connected to ends of the main body 110, although they may be various configurations in various embodiments. In various embodiments, various portions of the support may be connected to interior portions of the main body 110. In various embodiments, more or fewer supports may be connected to the main body than shown in the current exemplary embodiment.

A first top end support 120 is connected to the main body 110 at the first portion 121. The first top end support 120 includes a top end 122, a bottom end 124, a left end 126, a right end 128, an inner surface 127, and an outer surface (not shown). A second top end support 130 is connected to the main body 110 at the second portion 123. The second top end support 130 includes a top end 132, a bottom end 134, a left end 136, a right end 138, an inner surface 137, and an outer surface (not shown). A third top end support 140 is connected to the main body 110 at the third portion 125. The third top end support 140 includes a top end 142, a bottom end 144, a left end 146, a right end 148, an inner surface 147, and an outer surface (not shown). Both the left end 126 and the right end 148 are angled at a non-square angle with respect to the other ends in the current embodiment. The angle in the current embodiment is approximately forty-five degrees, although any angle may be used. In some embodiments, a square angle—such as 0 degrees or 90 degrees—may be used. In the current embodiment, the angle allows some relief for ease of insertion when inserting the blank 100, as formed into packaging, into a box.

A first bottom end support 150 is connected to the main body 110 at the first portion 141. The first bottom end support 150 includes a top end 152, a bottom end 154, a left end 156, a right end 158, an inner surface 157, and an outer surface (not shown). A second bottom end support 160 is connected to the main body 110 at the second portion 143. The second bottom end support 160 includes a top end 162, a bottom end 164, a left end 166, a right end 168, an inner surface 167, and an outer surface (not shown). A third bottom end support 170 is connected to the main body 110 at the third portion 145. The third bottom end support 170 includes a top end 172, a bottom end 174, a left end 176, a right end 178, an inner surface 177, and an outer surface (not shown). Both the left end 156 and the right end 178 are angled at a non-square angle with respect to the other ends in the current embodiment. The angle in the current embodiment is approximately forty-five degrees, although any angle may be used. In some embodiments, a square angle—such as 0 degrees or 90 degrees—may be used. In the current embodiment, the angle allows some relief for ease of insertion when inserting the blank 100, as formed into packaging, into a box.

A first left end support 180 is connected to the main body 110 at the first portion 161. The first left end support 180 includes a top end 182, a bottom end 184, a left end 186, a right end 188, an inner surface 187, and an outer surface (not shown). A second left end support 190 is connected to the main body 110 at the second portion 163. The second left end support 190 includes a top end 192, a bottom end 194, a left end 196, a right end 198, an inner surface 197, and an outer surface (not shown). Both the top end 182 and the bottom end 194 are angled at a non-square angle with respect to the other ends in the current embodiment. The angle in the current embodiment is approximately forty-five degrees, although any angle may be used. In some embodiments, a square angle—such as 0 degrees or 90 degrees—may be used. In the current embodiment, the angle allows some relief for ease of insertion when inserting the blank 100, as formed into packaging, into a box.

A first right end support 210 is connected to the main body 110 at the first portion 181. The first right end support 210 includes a top end 212, a bottom end 214, a left end 216, a right end 218, an inner surface 217, and an outer surface (not shown). A second right end support 220 is connected to the main body 110 at the second portion 183. The second left end support 220 includes a top end 222, a bottom end 224, a left end 226, a right end 228, an inner surface 227, and an outer surface (not shown). Both the top end 212 and the bottom end 224 are angled at a non-square angle with respect to the other ends in the current embodiment. The angle in the current embodiment is approximately forty-five degrees, although any angle may be used. In some embodiments, a square angle—such as 0 degrees or 90 degrees—may be used. In the current embodiment, the angle allows some relief for ease of insertion when inserting the blank 100, as formed into packaging, into a box.

Any dimensions shown in the drawings are for illustrative purposes only and should not be considered limiting on the disclosure or any claims issuing therefrom.

The blank 100 also includes six product braces. In the current embodiment, the product braces are flaps cut from the blank 100 to fold and to support any fragile item products to be placed therebetween. Although six product support braces are shown in the current embodiment, one of skill in the art would understand that the number or product support braces shown should not be limiting on the disclosure, as any number of product support braces may be used, and various numbers may provide various advantages for manufacturability as well as quality of support provided.

The blank 100 includes a first top support brace 230, a second top support brace 240, a first bottom support brace 260, a second bottom support brace 270, a left support brace 280, and a right support brace 290. Each support brace 230, 240,260,270,280,290 includes a top end 232,242,262,272, 282,292, a bottom end 234,244,264,274,284,294, a left end 236,246,266,276,286,296, a right end 238,248,268,278,288, 298, an inner surface (not illustrated), and an outer surface (not shown), respectively.

Each support brace is connected to the main body 110 along only one end. The first top support brace 230 is connected to the main body 110 only at the bottom end 234. The second top support brace 240 is connected to the main body 110 only at the bottom end 244. The first bottom support brace 260 is connected to the main body 110 only at the top end 262. The second bottom support brace 270 is connected to the main body 110 only at the top end 272. The left support brace 280 is connected to the main body 110 only at the right end 288. The right support brace 290 is connected to the main body 110 only at the left end 296. All other ends of the support braces are unconnected from the main body 110 in the current embodiment. In the current embodiment, each support brace is not connected to any other panel or flap. As such, each end of each support brace that is not connected to the main body 110 is not connected to any other features of the blank 100.

All connections as described with reference to the current embodiment are by bend lines. Bend lines to which this disclosure refers are designed as weakened regions, and may include a crease, a perforation, a series of perforations, or another arrangement to weaken the area of the bend line.

As such, the various supports (120,130,140,150,160,170, 180,190,210,220) are connected to the main body 110 by bend lines. Similarly, the various support braces (230,240, 260,270,280,290) are connected to the main body 110 by bend lines.

Each support brace includes multiple adjustability contours that allow adjustability for various sized fragile items. In the current embodiment, the adjustability contours are internal bend lines, although one of skill in the art would understand that various configurations and modifications may be made in various embodiments to accommodate various sized fragile items. In the current embodiment, each support brace includes four or five internal bend lines, although one of skill in the art would understand that various configurations of internal bend lines may be used in various embodiments to achieve added adjustability and/or added rigidity depending on the application. One of skill in the art would understand that various embodiments may include up to many adjustability contours and as few as no adjustability contours.

In the current embodiment, the first top support brace 230 includes adjustability contour bend lines 235*a,b,c,d*. The second top support brace 240 includes adjustability contour bend lines 245*a,b,c,d*. The first bottom support brace 260 includes adjustability contour bend lines 265*a,b,c,d,e*. The second bottom support brace 270 includes adjustability contour bend lines 275*a,b,c,d,e*. The left support brace 280 includes adjustability contour bend lines 285*a,b,c,d,e*. The right support brace 290 includes adjustability contour bend lines 295*a,b,c,d,e*. The blank 100 also includes a handle cutout 300. A punchout may be included inside the handle cutout 300 in various embodiments. In some embodiments, the handle cutout 300 will not be present.

Figure 2:
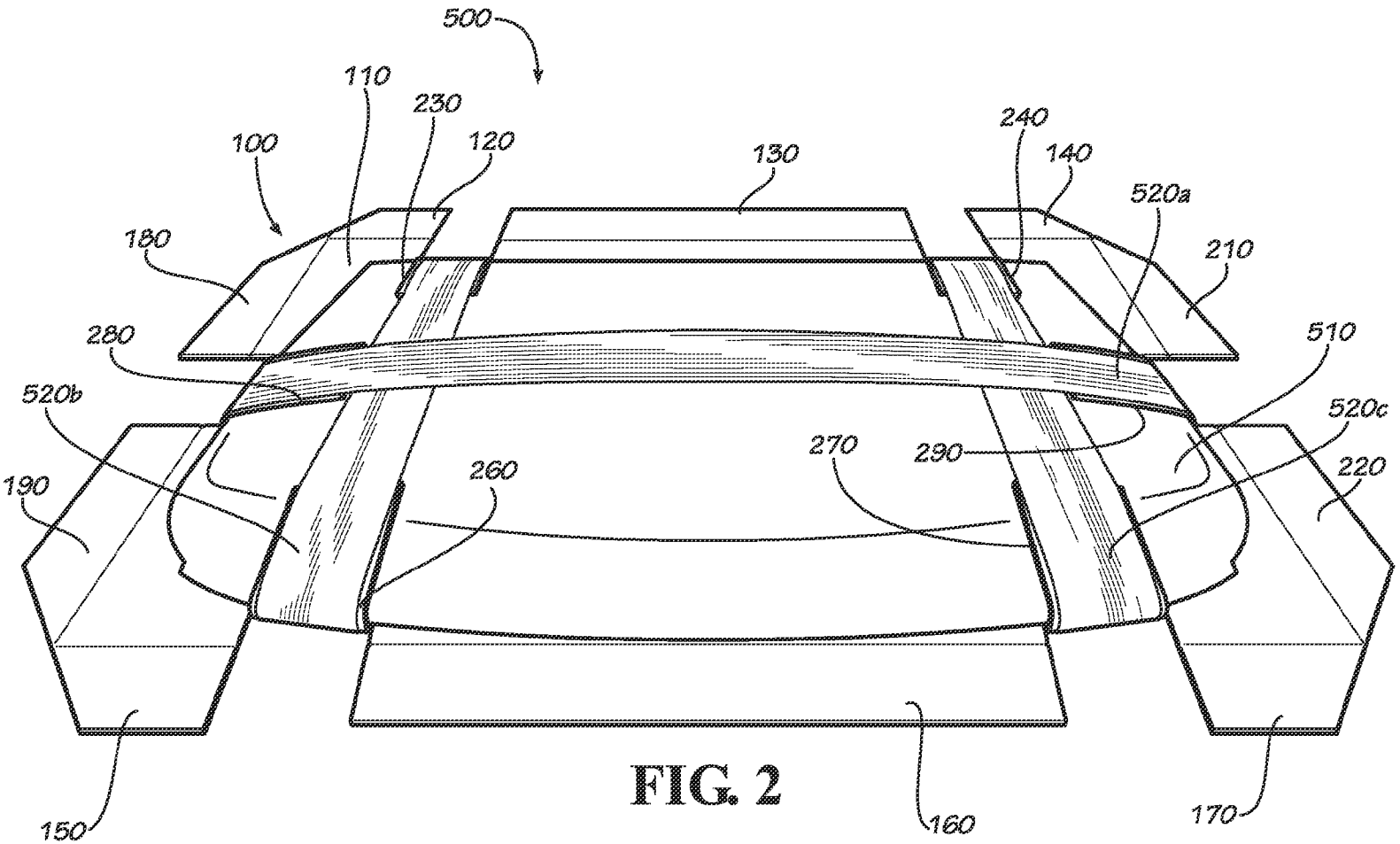
FIG. 2 is a perspective view of a packing system including the blank of FIG. 1 and shrinkwrapping packaging auto glass.

In use, a fragile item is placed on the blank 100 as shown in FIG. 2. In the current exemplary embodiment, the fragile item is a sheet of auto glass. It has been seen in the auto glass industry that shipping auto glass in substandard packaging can result in lost product, as shakes and dropped packaging can cause stresses on the auto glass that may cause it to fracture. However, most packaging that can support auto glass has Styrofoam corners or other foam spacers to provide some shock relief if the packaging is dropped or jarred. While this solution can work effectively in many cases, it is not inexpensive, as Styrofoam spacers can cost seven dollars or more per spacer.

As seen in FIG. 2, the auto glass 510 is placed proximate the main body 110. Support braces 230,240,260,270,280,290 are folded around the auto glass 510 along various adjustability contour bend lines (235*a-d*, 245*a-d*, 265*a-e*, 275*a-e*, 285*a-e*, 295*a-e*) to contact edges of the auto glass 510 on each side of the auto glass. Shrinkwrapping 520*a,b,c* is placed around the auto glass 510 at each of the support braces 230, 240,260,270,280,290. In the current embodiment, support brace 230 is oriented adjacent to support brace 260, support brace 240 is oriented adjacent to support brace 270, and support brace 280 is oriented adjacent to support brace 290 such that the shrink wrapping 520*a,b,c* can be fed within notches created by the folding of support braces 230,240,260, 270,280,290 along adjustability contour bend lines (235*a-d*, 245*a-d*, 265*a-e*, 275*a-e*, 285*a-e*, 295*a-e*). The shrink wrapping 520*a,b,c* effectively couples the auto glass 510 to the blank 100. The blank 100 and the shrink wrapping 520*a,b,c* together form a packaging system 500 to package the auto glass 510. One of skill in the art would understand that other methods and apparatus aside from shrink wrapping 520*a,b,c* can be used to couple the auto glass 510 to the blank 100. Any coupling member apparatus can be used, and various embodiments might include twine, string, corrugated cardboard, metal, foam, Styrofoam, adhesives, and other types of couplings.

When the packaging system 500 and the auto glass 510 are coupled together, the blank 100 is designed to fold to provide added support to the packaging. Each support 120,130,140, 150,160,170,180,190,210,220 can be folded along the bend line connections to the main body 110 (as seen and described with reference to FIG. 1) such that each support 120,130,140, 150,160,170,180,190,210,220 is oriented at an angle with respect to the main body 110. The angle in the current embodiment is orthogonal to the main body 110. Bending the supports 120,130,140,150,160,170,180,190,210,220 provides space between the main body 110 and a box 700 (seen in FIG. 3) into which the packaging system 500 and the auto glass 510 are inserted.

Figure 3:
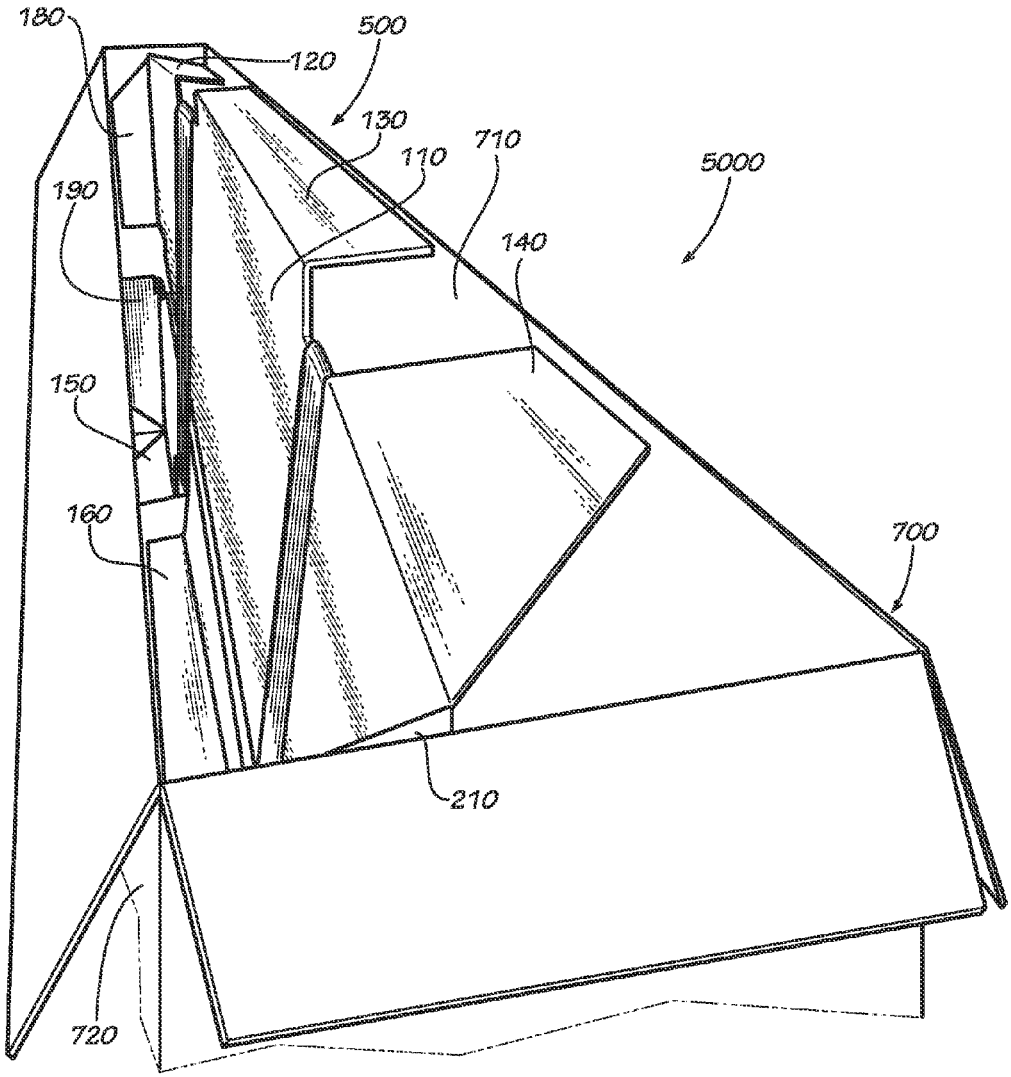
FIG. 3 is a perspective view of a packaging system including the packaging system and auto glass of FIG. 2 and a box.

As seen in FIG. 3, once the supports 120,130,140,150,160, 170,180,190,210,220 are bent, the packaging system 500 can be inserted into the box 700. The box 700 along with the packaging system 500 become a packaging system 5000 for packaging fragile items.

As can be seen, each support 120,130,140,150,160,170, 180,190,210,220 (supports 170 and 220 not shown) is bent so that an end of the support 120,130,140,150,160,170,180,190, 210,220 contacts an inner surface of the box 700. This contact allows the supports 120,130,140,150,160,170,180,190,210, 220 to provide structural support in case of a drop or stacking of the box 700 and the packaging system 5000 with other items. In use, should any user drop the box 700 and packaging system 500, coupling the auto glass 510 to the packaging system 500 allows the blank 100 to absorb enough force from the impact to prevent the auto glass 510 from breaking.

If the box 700 is dropped on a plane congruent with the main body 110, the rigidity of the main body 110 will support the auto glass 510 since the auto glass 510 is coupled to the main body 110 with shrink wrapping 520*a,b,c*. In most embodiments, the auto glass 510 will not extend to the edge of the main body 110, so any edge of the auto glass 510 will be supported by shrink wrapping 520*a,b,c* and the main body 110. Since the auto glass 510 does not extend to the edge of the main body 110 in most embodiments, the auto glass 510 will not be subject to corner or edge impact that could chip or crack the auto glass 510 in the event of a drop. If the box 700 is dropped in a plane other than congruent with the main body 110, the supports 120,130,140,150,160,170,180,190,210,220, angled orthogonally with respect to the main body 110, provide support and some rigidity in planes not congruent with the main body 110. As such, the auto glass 510 will be supported through its coupling by shrink wrapping 520*a,b,c* to the blank 100 by the supports 120,130,140,150,160,170,180,190,210,220.

As seen in FIG. 3, the supports 120,130,140,150,160,170, 180,190,210,220 of the current embodiment are folded with respect to the main body 110 in alternating directions so that some supports 120,130,140,150,160,170,180,190,210,220 support against a front or first side 710 of the box 700 and some support against a back or second side 720 of the box 700. As such, the packaging system 500 provides support against the box 700 in both directions. Although supports 120,130,140 are shown supporting against the first side 710 of the box 700 and supports 180,190,150,160 are shown supporting against the second side 720 of the box 700, any configuration may be used in the current embodiment, although a configuration with at least one support 120,130, 140,150,160,170,180,190,210,220 supporting against each of the first side 710 and the second side 720 is advised in the current embodiment.

As shown and described, the configuration of the current embodiment eliminates expensive packaging solutions for large fragile items such as auto glass 510, providing consistent support through a corrugated cardboard solution. One of skill in the art would understand that various modifications and design embodiments may be made without departing from the general scope of the disclosure, and the disclosure as pertaining to the current embodiment should not be considered a limit on the scope of any claims issuing herefrom.

This disclosure represents one of many possible assembly configurations. One skilled in the art will understand obvious variations of this disclosure are intended to be included, including variations of steps, combinations of steps, and dissections of steps, among others. Where materials are chosen for the elements of this assembly, similar material choices may also be used and would be obvious to one in the art.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

Where materials are chosen for the elements of this assembly—particularly, corrugated cardboard—similar generally rigid material choices may also be used and would be obvious to one in the art, including corrugated cardboard or paper, linerboard, polymer, plastic, metal, alloy, wood, mesh, laminate, reinforced woven or nonwoven fabric, cellulose, composite, and combinations or mixtures of the foregoing, among others.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

Various implementations described in the present disclosure may include additional systems, methods, features, and advantages, which may not necessarily be expressly disclosed herein but will be apparent to one of ordinary skill in the art upon examination of the detailed description and accompanying drawings. It is intended that all such systems, methods, features, and advantages be included within the present disclosure and protected by the accompanying claims.

That which is claimed is:

1. A method of packaging comprising:

obtaining a blank, the blank including a main body with a front surface and a back surface, a first body end, a first support, a second support, and at least one support brace having at least three bend lines, wherein the first support and at least one support brace are at the first body end, wherein the first support includes an outer end, a first side end adjacent to the outer end of the first support, and a second side end adjacent to the outer end and distal from the first side end of the first support, wherein the outer end, the first side end, and the second side end of the first support each define a straight edge, wherein the first side end is angled at a square angle with respect to the outer end of the first support, wherein the second side end is angled at a non-square angle with respect to the outer end of the first support, wherein the second support includes an outer end, a first side end adjacent to the outer end, and a second side end adjacent to the outer end and distal from the first side end of the second support, wherein the outer end, the first side end, and the second side end of the second support each define a straight edge, and wherein the first side end and the second side end are angled at square angles with respect to the outer end of the second support;

placing an item proximate the front surface of the blank;

folding the at least one support brace around the item;

folding the first support at an angle with respect to the main body; and placing the blank and the item in a box, the box including a front lateral side and a back lateral side distal from the front lateral side, wherein the blank is placed in the box such that the blank contacts each of the front lateral side and the back lateral side, the back surface of the main body faces the back lateral side, the front surface of the main body faces the front lateral side, the back surface is not in contact the back lateral side, and the front surface is not in contact with the front lateral side.

2. The method of packaging of claim 1, further comprising placing shrinkwrap around the item and the blank.

3. The method of packaging of claim 1, wherein the item is auto glass.

4. The method of packaging of claim 1, further comprising:

folding the second support at an angle with respect to the main body, the second support extending from the main body in a direction opposite to a direction the first support extends from the main body;

wherein placing the blank and the item in the box includes placing the first support in contact with the front lateral side of the box and placing the second support in contact with the back lateral side of the box.

5. The method of packaging of claim 1, wherein placing the blank and the item in the box includes inserting the blank between a first side of the box and a second side of the box.

6. The method of packaging of claim 1, wherein the second support is at a second body end of the main body.

7. The method of packaging of claim 6, wherein the first support is connected to the first body end and the second support is connected to the second body end, the first body end and the second body end defining a corner, the first support and the second support adjacent to the corner.

8. The method of packaging of claim 1, wherein the blank includes at least a top body end, a bottom body end, a right body end, and a left body end.

9. The method of packaging of claim 8, wherein the main body includes eight supports including the first support and the second support, and wherein at least two supports of the eight supports are positioned on each of the top body end, the bottom body end, the left body end, and the right body end.

10. The method of packaging of claim 9, wherein:

each of the at least two supports positioned on each of the top body end, the bottom body end, the left body end, and the right body end oriented at an angle with respect to the main body.

11. The method of packaging of claim 9, wherein the at least one support brace includes a first support brace, a second support brace, a third support brace, and a fourth support brace, and wherein folding the at least one support brace around the item includes folding the first support brace, the second support brace, the third support brace, and the fourth support brace around the item placed proximate the main body.

12. The method of packaging of claim 8, wherein the at least one support brace includes a first support brace, a second support brace, a third support brace, and a fourth support brace, and wherein folding the at least one support brace around the item further comprises:

folding the first support brace at a bottom end such that the first support brace is oriented at an angle with respect to the main body, the bottom end connected to the main body inward on the main body from the top body end, the first support brace having a top end outward on the main body from the top body end;

folding the second support brace at a right end such that the second support brace is oriented at an angle with respect to the main body, the right end connected to the main body inward on the main body from the left body end, the second support brace having a left end outward on the main body from the left body end;

folding the third support brace at a top end such that the third support brace is oriented at an angle with respect to the main body, the top end connected to the main body inward on the main body from the bottom body end, the third support brace having a bottom end outward on the main body from the bottom body end; and folding the fourth support brace at a left end such that the fourth support brace is oriented at an angle with respect to the main body, the left end connected to the main body inward on the main body from the right body end, the fourth support brace having a right end outward on the main body from the right body end.

13. The method of packaging of claim 1, further comprising extending a wrapping material around the main body and holding the at least one support brace against the item.

14. The method of claim 1, wherein the non-square angle is forty-five degrees.

15. A method of erecting and packaging a blank, the method comprising:

obtaining a blank, the blank including a main body with a front surface and a back surface, a first body end, a first support, a second support, and at least one support brace having at least three bend lines, wherein the first support and at least one support brace are at the first body end, wherein the first support includes an outer end, a first side end adjacent to the outer end of the first support, and a second side end adjacent to the outer end and distal from the first side end of the first support, wherein the outer end, the first side end, and the second side end of the first support each define a straight edge, wherein the first side end is angled at a square angle with respect to the outer end of the first support, wherein the second side end is angled at a non-square angle with respect to the outer end of the first support, wherein the second support includes an outer end, a first side end adjacent to the outer end, and a second side end adjacent to the outer end and distal from the first side end of the second support, wherein the outer end, the first side end, and the second side end of the second support each define a straight edge, and wherein the first side end and the second side end are angled at square angles with respect to the outer end of the second support;

folding the at least one support brace at an angle oriented with respect to the main body such that the at least one support brace is positioned to secure an item proximate to the main body; and folding the first support at an angle oriented with respect to the main body;

placing the blank in a box, the box including a front lateral side and a back lateral side distal from the front lateral side, wherein the blank is placed in the box such that the blank contacts each of the front lateral side and the back lateral side, the back surface of the main body faces at least one of the front lateral side and the back lateral side, the front surface of the main body faces the front lateral side, the back surface is not in contact with the back lateral side, and the front surface is not in contact with the front lateral side.

16. The method of claim 15, wherein the first support is connected to a first body end and the second support is connected to a second body end, the first body end and the second body end defining a corner, the first support and the second support adjacent to the corner.

17. The method of claim 15, wherein the blank includes at least a top body end, a bottom body end, a right body end, and a left body end, wherein the main body includes eight supports including the first support and the second support, and wherein at least two supports of the eight supports are positioned on each of the top body end, the bottom body end, the left body end, and the right body end.

18. The method of claim 17, wherein the at least one support brace includes a first support brace, a second support brace, a third support brace, and a fourth support brace, the step of folding the at least one support brace at an angle oriented with respect to the main body further comprises:

folding the first support brace at a bottom end such that the first support is oriented at an angle with respect to the main body, the bottom end connected to the main body inward on the main body from the top body end, the first support brace having a top end outward on the main body from the top body end;

folding the second support brace at a right end such that the second support is oriented at an angle with respect to the main body, the right end connected to the main body inward on the main body from the left body end, the second support brace having a left end outward on the main body from the left body end;

folding the third support brace at a top end such that the third support is oriented at an angle with respect to the main body, the top end connected to the main body inward on the main body from the bottom body end, the third support brace having a bottom end outward on the main body from the bottom body end; and folding the fourth support brace at a left end such that the fourth support is oriented at an angle with respect to the main body, the left end connected to the main body inward on the main body from the right body end, the fourth support brace having a right end outward on the main body from the right body end.

19. A method of packaging comprising:

obtaining a blank, the blank including a main body with a front surface and a back surface, at least one end, a first support, a second support, and at least one support brace having at least three bend lines, wherein the first support and at least one support brace are at the at least one end, wherein the first support includes an outer end, a first side end adjacent to the outer end of the first support, and a second side end adjacent to the outer end and distal from the first side end of the first support, wherein the outer end, the first side end, and the second side end of the first support each define a straight edge, wherein the first side end is angled at a square angle with respect to the outer end of the first support, wherein the second side end is angled at a non-square angle with respect to the outer end of the first support, wherein the second support includes an outer end, a first side end adjacent to the outer end, and a second side end adjacent to the outer end and distal from the first side end of the second support, wherein the outer end, the first side end, and the second side end of the second support each define a straight edge, and wherein the first side end and the second side end are angled at square angles with respect to the outer end of the second support;

placing an item proximate the blank;

securing the item proximate to the main body by using the at least one support brace;

positioning the first support at an angle oriented with respect to the main body; and placing and securing the blank and the item in a box, the box including a front lateral side and a back lateral side distal from the front lateral side, wherein the blank is placed in the box such that the blank contacts each of the front lateral side and the back lateral side, the back surface of the main body faces the back lateral side, the front surface of the main body faces the front lateral side, the back surface is not in contact with the back lateral side, and the front surface is not in contact with the front lateral side.

* * * * *